US006752564B1

(12) United States Patent
Iskhakbayev

(10) Patent No.: US 6,752,564 B1
(45) Date of Patent: Jun. 22, 2004

(54) ROADWAY BARRIER FOR PROTECTING PEDESTRIANS

(76) Inventor: Yuriy Iskhakbayev, 105-40 62 Rd., #3N, Forest Hills, NY (US) 11375

( * ) Notice: Subject to any disclaimer, the term of this patent is extended or adjusted under 35 U.S.C. 154(b) by 0 days.

(21) Appl. No.: 10/646,091

(22) Filed: Aug. 25, 2003

Related U.S. Application Data

(63) Continuation of application No. 10/115,371, filed on Apr. 4, 2002, now abandoned.

(51) Int. Cl.[7] ..... E01F 15/00
(52) U.S. Cl. ..... 404/6
(58) Field of Search ..... 404/6, 9; 256/13.1; 116/63 T, 63 P

(56) References Cited

U.S. PATENT DOCUMENTS

| | | | | | |
|---|---|---|---|---|---|
| 1,532,633 | A | | 4/1925 | Noble | |
| 2,129,503 | A | * | 9/1938 | Mulieri | 404/6 |
| 3,141,655 | A | | 7/1964 | Platt | |
| 3,326,099 | A | | 6/1967 | Cova | |
| 3,448,983 | A | | 6/1969 | Gravisse | |
| 4,065,104 | A | * | 12/1977 | Pass | 256/13.1 |
| 4,818,138 | A | * | 4/1989 | Brown | 404/14 |
| 4,879,545 | A | * | 11/1989 | Aguilar | 340/624 |
| 5,336,016 | A | * | 8/1994 | Baatz | 404/6 |
| 5,443,324 | A | | 8/1995 | Sullivan | |
| 5,938,370 | A | * | 8/1999 | Gzybowski | 404/6 |
| 6,200,063 | B1 | * | 3/2001 | Fritzinger | 404/6 |
| 6,491,470 | B1 | * | 12/2002 | Gertz | 404/6 |
| 2002/0062780 | A1 | * | 5/2002 | Chen | 116/63 P |

* cited by examiner

*Primary Examiner*—Thomas B. Will
*Assistant Examiner*—Raymond W Addie
(74) *Attorney, Agent, or Firm*—Boris Leschinsky

(57) ABSTRACT

A pedestrian protection barrier having two half-barriers, one on each side of a pedestrian crosswalk. The half-barrier is constructed of two segment-blocks placed adjacently at a center-line of a roadway. Each segment-block has a lower portion, an upper portion, two side-walls and an exterior wall with an optional hollow cavity therein. When segment-blocks are installed on the roadway, the lower portion of each segment-block is placed into a cavity excavated in the ground of the roadway. The upper portion extends above the ground of the roadway to protect pedestrians. One pair of segment-blocks' side-walls form an angle therebetween. The other pair of the side-walls can be located adjacently and parallel to one another and to the centerline of the roadway. Both half-barriers face away from the crosswalk and towards the incoming traffic.

10 Claims, 2 Drawing Sheets

ROADWAY BARRIER FOR PROTECTING PEDESTRIANS

CROSS-REFERENCE DATA

This application is a continuation of a U.S. application Ser. No. 10/115,371 filed Apr. 4, 2002 now abandoned by the same inventor and with the same title, which is incorporated herewith in its entirety by reference.

FIELD OF THE INVENTION

The present invention relates to a roadway barrier for protecting pedestrians from an impact by a moving vehicle. In particular, the safety barrier of the present invention consists of two halves of generally triangular shape located on both sides of a pedestrian safety zone and designed to deflect any incoming traffic back into the roadway and away from pedestrians standing in a safety zone.

BACKGROUND OF THE INVENTION

Media barriers are often disposed between opposing lanes of traffic on a divided highway to prevent head-on collisions. A common form of such media barrier are formed of pre-cast or poured concrete structures somewhat bell-shaped in cross section and having a wide bottom to resist tipping from impact with an automobile or other vehicle and a flared lower section to engage the tire of a vehicle veering from the road into the barrier and a more or less vertical upper section rising to a flattened barrier top. The flared lower section allows the vertical upper section to be set back far enough to provide clearance for the body of the vehicle. Thus, if a vehicle veers into the barrier at a small angle, the barrier acts to turn the car back onto the roadway to prevent a possible head-on collision with vehicles in the lanes of opposing traffic.

U.S. Pat. No. 5,302,047 discloses one example of an along-side pedestrian safety barrier, which is adapted to be longitudinally disposed between a roadway and an adjoining pedestrian walkway. The disclosed safety barrier features a concrete structure raised to about 24 inches in height and having an outwardly angled sidewall facing the roadway and a concavity on its bottom surface to engage the top and roadside surface of a standard curb.

Energy absorbing barriers have also been used to protect pedestrians. For example, U.S. Pat. No. 5,292,467 discloses an energy absorbing roadway barrier for dissipating kinetic energy upon impact by a moving vehicle includes an elongated core of reinforced high density concrete having barrier anchor members attached from the elongated core to a position for anchoring the barrier. An elongated barrier portion is formed around the elongated core and around the core anchor members to form a road barrier.

Existing axial, i.e., central line, barriers, however, do not rise to a height sufficient to protect pedestrians from a vehicular impact. Additionally, many of the presently available protection barriers have a curvature around a pedestrians'"safety island" or "safety zone" in the middle of the road. This curvature allows cars to ride onto the territory of the "safety island" instead of protecting this territory. The need therefore exists for a barrier capable of protecting the pedestrians by preventing the traffic from crossing over the pedestrian crosswalk.

SUMMARY OF THE INVENTION

It is an object of the present invention to provide a barrier for protecting pedestrians from a vehicular traffic.

It is another object of the present invention to provide a pedestrian protecting barrier mounted at a pedestrian's crosswalk.

It is a further object of the present invention to provide a pedestrian protecting barrier, which protects pedestrians by preventing moving vehicles from crossing the barrier.

In accordance with the present invention, a pedestrian protection barrier is provided. The protection barrier has two half-barriers, each of the half-barriers placed on one side of a pedestrian crosswalk. The half-barrier is constructed of two segment-blocks placed adjacently at a centerline of a roadway. Each segment-block has a lower portion, an upper portion, two side-walls and an exterior wall. When segment-blocks are installed on the roadway, lower portion of each segment-block is placed into a cavity excavated in the ground of the roadway. The upper portion extends above the ground of the roadway to protect pedestrians. One pair of segment-blocks' side-walls form an angle therebetween. The other pair of the side-walls can be located adjacently and parallel to one another. In a second preferred embodiment, the other pair of the side-walls also forms an angle therebetween. A wedge block is then placed into the space formed by the spaced apart sides of segment-blocks to insure structural integrity of the resulting half-barrier.

The above and other objects, aspects, features and advantages of the invention will be more readily apparent from the description of the preferred embodiments thereof taken in conjunction with the accompanying drawings and appended claims.

BRIEF DESCRIPTION OF THE DRAWINGS

The invention is illustrated by way of example and not limitation and the figures of the accompanying drawings in which like references denote like or corresponding parts, and in which.

DETAILED DESCRIPTION OF THE PREFERRED EMBODIMENTS AND THE DRAWINGS

Figure 1:
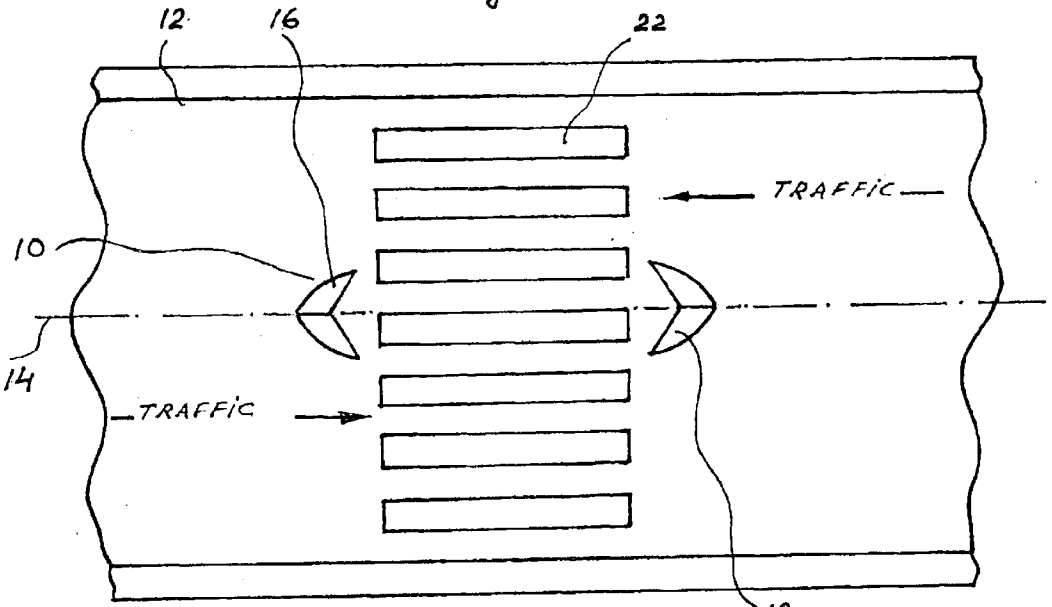
FIG. 1 is a top planar view of the pedestrians protecting barrier having two half-barriers placed on each side of the pedestrians' crosswalk, in accordance with the preferred embodiment of the invention.

A general roadway 12 is shown schematically on FIG. 1 to include one or more lanes of traffic going in one direction separated by a center-line 14 from one or more lanes of traffic going in the opposite direction. A generic pedestrian crosswalk 22 is shown positioned across the roadway 12. Note that in some cases the crosswalk 22 may be positioned at an angle other than 90 degrees to the roadway, which does not change the nature of the present invention. The roadway barrier design according to the present invention remains the same regardless of the orientation of the crosswalk to the roadway or the presence or absence of traffic lights as long as there is a safety zone for pedestrians located on the crosswalk about the centerline of the roadway.

In the preferred embodiment, a roadway barrier 10 for pedestrians' protection is provided along a center-line 14 of a roadway 12, as shown in FIG. 1. The barrier 10 preferably has two half-barriers 16 and 18 of generally triangular and pointed shape, one on each side of a pedestrians' crosswalk 22. It is preferred that half-barriers 16 and 18 are spaced to a distance within the range of 0.9 m–3 m. Each half-barrier 16 and 18 are pointed in opposite directions and away from the crosswalk 22 to face the incoming traffic of the roadway 12.

Figure 2:
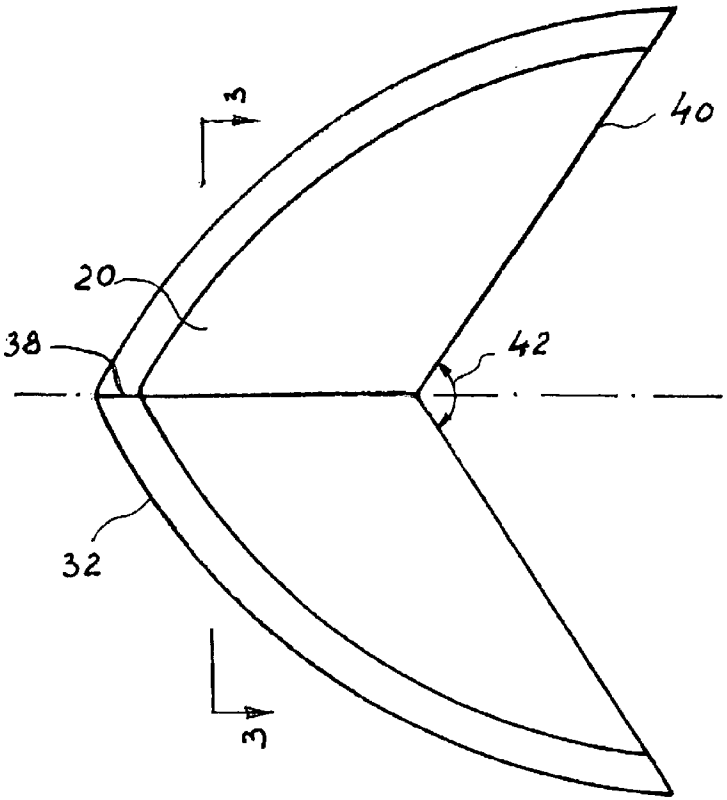
FIG. 2 is a top view of one half-barrier formed by two adjacently placed segment-blocks.

Each half-barrier 16 and 18 preferably comprises two triangular-shaped segment-blocks 20, as shown in FIG. 2. Each segment-block has a first side-wall 38, a second side-wall 40, and an exterior side-wall 32 facing the traffic on the roadway 12. When segment-blocks are installed on a roadway, two segment-blocks 20 are placed on each side of the centerline in such a way that the respective first side-walls 38 of each segment-block 20 originate from the same common point on the centerline of the roadway. They are facing each other and located adjacent and parallel to the centerline 14 and respectively to each other. The other pair of respective second side-walls 40 forms a first angle 42 therebetween facing the pedestrian crosswalk. This defines a generally triangular shape of the half-barriers 16 and 18. Note that each triangularly-shaped half-barrier is pointed in a direction away from the crosswalk so as to face the incoming traffic.

Figure 3:
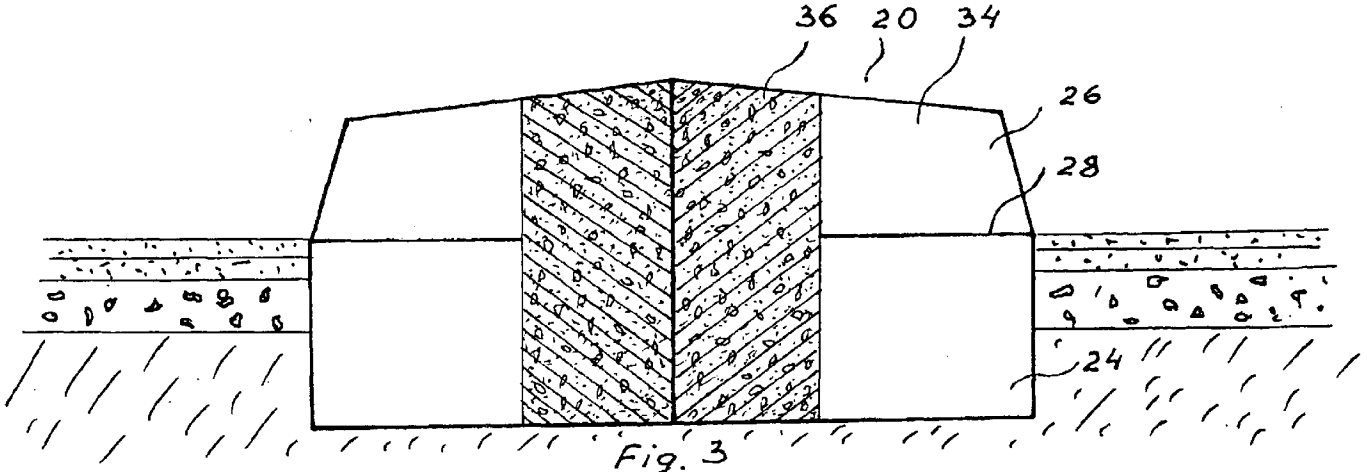
FIG. 3 is a cross-sectional view of the half-barrier of FIG. 2 taken along line 3—3.

As shown in the cross-sectional view of FIG. 3, the segment-block 20 has a lower portion 24, an upper portion 26 and a horizontal line 28. The lower portion 24 preferably serves as a foundation of the segment-block 20. The horizontal line 28 preferably indicates the level corresponding to a ground level for an installed segment-block. Therefore, only the upper portion 26 of each segment-block 20 will be visible when segment-blocks are installed according to the invention.

Figure 4:
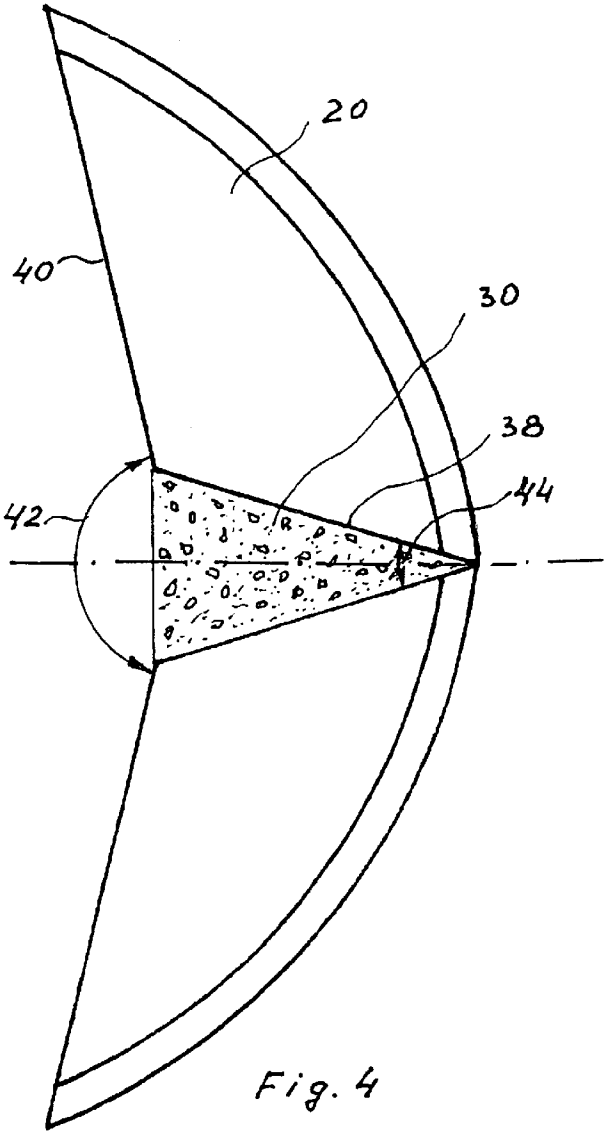
FIG. 4 is a top view of one half-barrier formed by two segment-blocks forming an angle therebetween, in accordance with an alternative embodiment of the present invention.

As shown in FIG. 2 and FIG. 4, each segment-block has an exterior surface of the exterior side-wall 32. This surface is preferably curved. In the preferred embodiment, the radius of the curvature of the exterior surface is 22 cm.

In the preferred embodiment shown in FIG. 3, each segment-block 20 has an exterior hollow portion 34 and a solid portion 36. The solid portion 36 is preferably made of a reinforced concrete and is capable of withstanding and absorbing a vehicular impact. The solid portion 36 provides a structural integrity of the segment-block 20.

The hollow portion 34 is formed along the exterior side-wall 32. The hollow portion 34 is provided, for example, to allow passengers to stand in waiting for a green light. Alternatively, the hollow portion 34 may be used for storing bicycles, scooters and other equipment. In another embodiment, the hollow portion 34 may be used for planting flowers, placing advertisements, and for other decorative purposes. In a further embodiment, the entire segment-block 20 may be formed as a solid block of reinforced concrete.

In another preferred embodiment, shown in FIG. 4, first side-walls 38 originate from a common point located on a centerline 14 of the roadway 12 but then are spaced apart forming a second angle 44 therebetween. This embodiment allows segment-blocks to form a greater first angle 42 between side-walls 40. A wedge-block 30 is preferably placed into the space formed by side-walls 38 of two segment-blocks 20 to enable a structural integrity of the resulting half-barrier.

To install the provided barrier, installers should first excavate cavities in the roadway for placing lower portions 24 of segment-blocks 20. Segment-blocks are then assembled in pairs to form half-barriers, which are then placed into their corresponding cavities such that horizontal lines 28 are located at the ground level. Upper portions of the segment-blocks preferably extend above the ground sufficiently to protect pedestrians from any vehicular impact. Any openings between a half-barrier and walls of its cavity should be stuffed with appropriate materials and then covered with asphalt.

The above invention is depicted as a pedestrian's barrier located along a center-line of a roadway. Alternately, the barrier may be placed between two roads going in the same direction, for example between a main road and a service road, and even on a side of the roadway at either end of the crosswalk Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A pedestrian protection barrier for a roadway having a centerline and a pedestrian crosswalk crossing thereof, said pedestrian barrier comprising:

two half-barriers, one on each side of said pedestrian crosswalk, said half-barriers each having a generally triangular shape, said half-barriers pointed in the opposite directions and away from said crosswalk;

each of said half-barriers further comprising two segment-blocks, each of said segment-blocks having a lower portion and an upper portion, each of said segment-blocks having a generally triangular shape defined by a first side-wall, a second side-wall and an exterior side-wall facing traffic of said roadway;

wherein each of said half-barriers is formed by a pair of said segment-blocks having their lower portions installed inside the ground of said roadway and their upper portions extending above the ground of said roadway to protect pedestrians, said first side-walls of each respective pair of said segment-blocks originating at the same common point on the centerline of said roadway, said respective second side-walls forming a first angle therebetween.

2. The pedestrian protection barrier as in claim 1, wherein said first side-walls of each pair of said segment-blocks located adjacently and are parallel to each other and to said centerline.

3. The pedestrian protection barrier as in claim 1, wherein said first side-walls of each pair of said segment-blocks forming a second angle therebetween.

4. The pedestrian protection barrier according to claim 3, wherein a wedge block is placed into a space formed by said first side-walls of said pair of segment-blocks.

5. The pedestrian protection barrier according to claim 1, wherein said exterior side-wall comprises a curvature.

6. The pedestrian protection barrier according to claim 1, wherein each of said segment-blocks comprises a solid portion and a hollow portion.

7. The pedestrian protection barrier according to claim 6, wherein said solid portion is made of reinforced concrete.

8. The pedestrian protection barrier as in claim 6, wherein said hollow portion is positioned along said exterior side-wall.

9. The pedestrian protection barrier as in claim 1, wherein said second side-walls facing said crosswalk.

10. A pedestrian protection barrier for a roadway having a centerline and a pedestrian crosswalk crossing thereof, said pedestrian barrier comprising:

two half-barriers, one on each side of said pedestrian crosswalk, said half-barriers each having a generally triangular shape, said half-barriers pointed in the opposite directions and away from said crosswalk;

each of said half-barriers further comprising a pair of segment-blocks and a wedge block, each of said segment-blocks having a lower portion and an upper portion, each of said segment-block having a generally triangular shape defined by a first side-wall, a second side-wall and an exterior side-wall facing traffic of said roadway;

wherein each of said half-barriers is formed by a pair of said segment-blocks having their lower portions installed inside the ground of said roadway and their upper portions extending above the ground of said roadway to protect pedestrians, said first side-walls of each respective pair of said segment-blocks originating at the same common point on the centerline of said roadway and forming a second angle therebetween to define a space, said wedge block is placed into said space formed by said first side-walls, said respective second side-walls forming a first angle therebetween and facing said crosswalk.

* * * * *